US005586920A

United States Patent [19]

Brown

[11] Patent Number: 5,586,920

[45] Date of Patent: Dec. 24, 1996

[54] BLADE RECEPTACLE

[75] Inventor: Donald C. Brown, Freehold, N.J.

[73] Assignee: Heyco Stamped Products, Inc., Toms River, N.J.

[21] Appl. No.: 389,946

[22] Filed: Feb. 17, 1995

[51] Int. Cl.[6] ..... H01R 11/22

[52] U.S. Cl. ..... 439/857; 439/862

[58] Field of Search ..... 439/842, 843, 439/851–857, 861, 862, 374, 378, 736

[56] References Cited

U.S. PATENT DOCUMENTS

| | | | |
|---|---|---|---|
| 2,727,299 | 12/1955 | Klumpp, Jr. | 29/155.55 |
| 3,245,031 | 4/1956 | Barney et al. | 439/861 |
| 3,487,356 | 12/1969 | Buck et al. | 439/861 |
| 3,729,701 | 4/1973 | Smith | 339/223 R |
| 3,836,947 | 9/1974 | Yeager | 339/259 R |
| 4,530,562 | 7/1985 | Reynolds | 339/191 R |
| 4,540,233 | 9/1985 | Saijo et al. | 339/258 R |
| 4,781,628 | 11/1988 | Detter et al. | 439/748 |
| 5,342,219 | 8/1994 | Onodera et al. | 439/861 |

*Primary Examiner*—David L. Pirlot
*Attorney, Agent, or Firm*—Auslander & Thomas

[57] ABSTRACT

A stamped metal female blade receptacle is three sided, having a longitudinal opening. There is a flat side and curved side. The metal is resilient so that the curved side releases from the plastic when molded into a plug. In a plug, the receptacle is supported against unwanted flexure and biased against a received blade, providing full surface contact on one side of the receptacle. The sides of the receptacle do not fatigue in use. The receptacle is economical of metal and adapted for automated crimping. The structure of the receptacle enables one size receptacle to serve blades of various widths and thicknesses.

The receptacles can be provided, integral on a stamping strip and alternately folded over, to be parallel to each other for machine crimping.

8 Claims, 2 Drawing Sheets

FIG.1
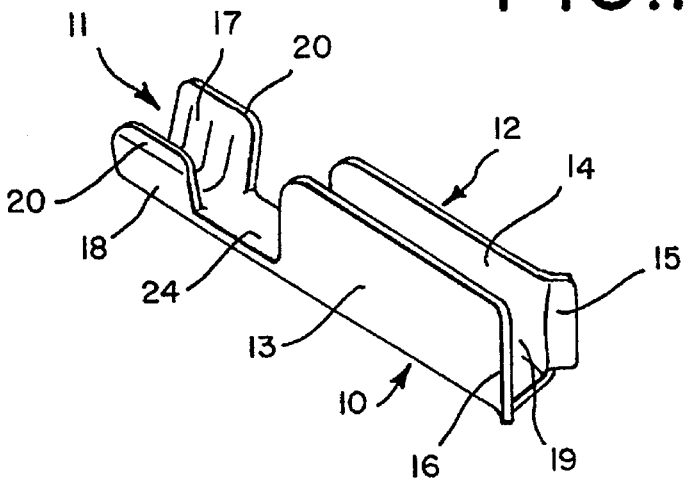
FIG.3
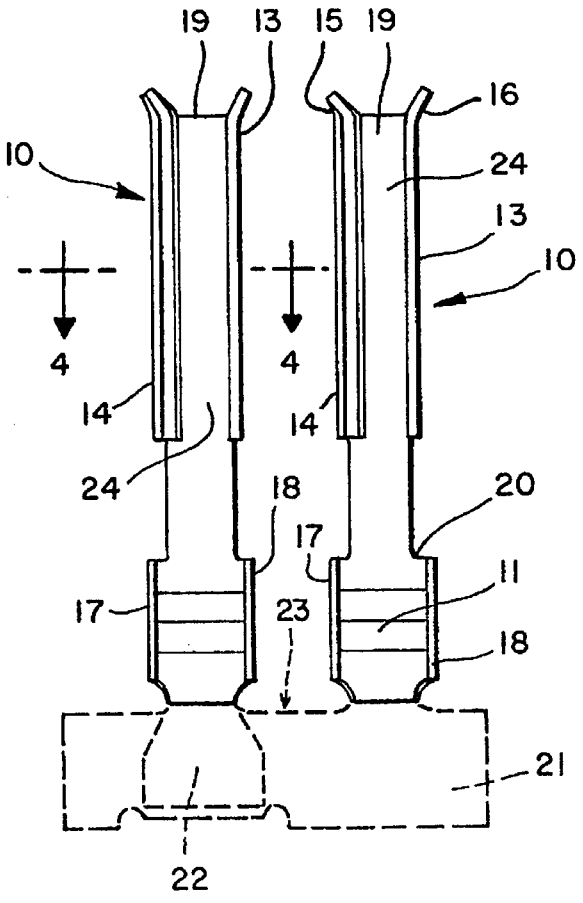
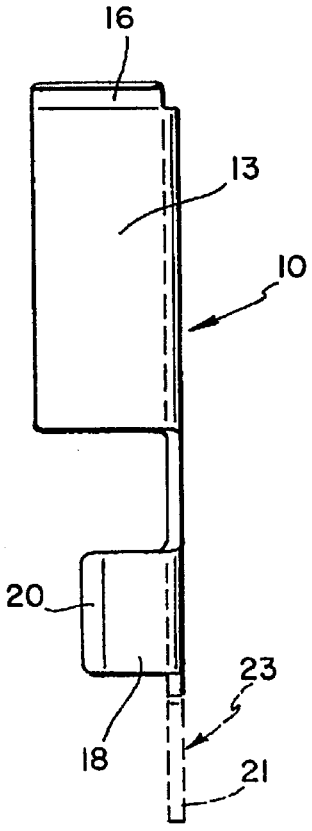
FIG.2

FIG.5
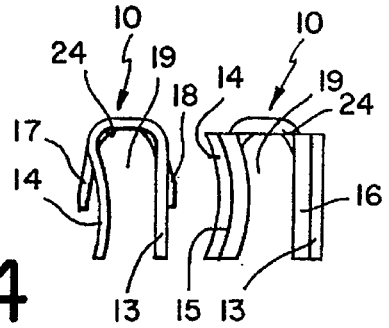
FIG.4
FIG.6
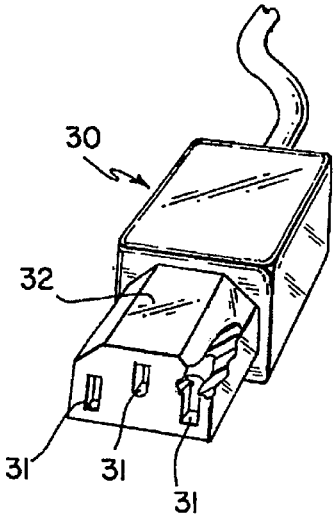
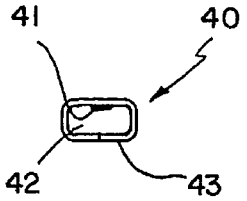
PRIOR ART
FIG.7
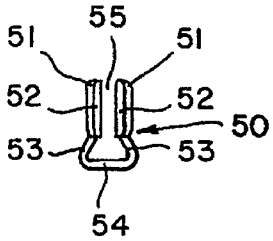
PRIOR ART
FIG.8
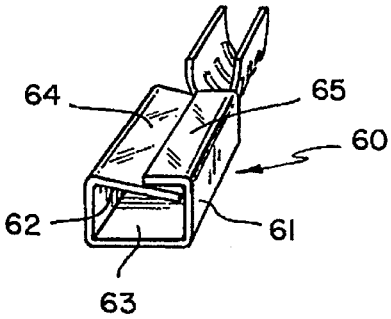
PRIOR ART
FIG.9

BLADE RECEPTACLE

BACKGROUND OF THE INVENTION

The present invention is a new female blade receptacle, electrical connector. The blade receptacle is particularly useful, in plugs for business machines and computers, where a female receptacle plug connects to a three blade male fitting on a computer or business machine. It may be used with electric blades and blades in plugs.

The present invention is particularly adapted in the automation of the making of female receptacle plugs. The blade receptacles are preferably progressively stamped on a stamping strip. Alternate blade receptacles are overfolded so that all blade receptacles extend on the same plane from the stamping strip end. By being thus constructed, the blade receptacles can be put on reels and fed into crimping machines were wire sets may be machine crimped to the blade receptacles.

The present invention is a stamped metal female blade receptacle having three sides and a longitudinal opening. There is a flat side and curved side. The metal is resilient so that the curved side releases from the plastic when molded into a plug. In a plug the receptacle is supported against unwanted flexure and biased against a received blade providing full surface contact on one side of the receptacle. The sides of the receptacle do not fatigue in use. The receptacle is economical of metal and adapted for automated crimping. The structure of the receptacle enables one size receptacle to serve blades of various widths and thicknesses.

The female receptacle may be used in automated procedures in conjunction with premolds or cores. Premolds or cores better enable machine crimping and enable easier and better positioning of the female blade receptacles for final molding into a plug.

The receptacles can be provided, integral on a stamping strip and alternately folded over to be parallel to each other for machine crimping.

DESCRIPTION OF THE RELATED ART

Prior blade receptacles, such as a box contact, depended upon dimples or elevations, in order to assure a good electric contact. Such receptacles were limited with regard to the width and thickness of the blade, and further, tended to wear out at the dimple with repeated use, weakening the integrity of the electrical contact.

Another prior art blade receptacle comprised two open arms in a bent, spring-like configuration, to grasp a blade. These connectors, while flexible as to both width and thickness of the blade, provided angulated contact of a limited nature.

Another prior art connector, in the form of a box, provided a longitudinal wall, overlain by another longitudinal wall, acting somewhat as a biasing spring, biasing the under wall to be in line contact with a blade and holding the blade fully against the opposite wall in good electrical contact. The problem with such a contact is that, as a box, it is limited with regard to any variations in blade widths and blade thicknesses. Such a contact also tends to fatigue in use at its corners and to also lose its spring-like resilience in maintaining electrical contact.

Annexed hereto is Form PTO-1449 and copies of the patents and prior art cited therein.

U.S. Pat. No. 4,530,562 discloses an electrical contact for a blade, with a pair of side portions and a pair of overhanging and overlapping portions extending from the side portions, to define an insertion region. The contact provides contact force between the contact and the blade, the blade biasing both overhanging portions when inserted.

U.S. Pat. No. 3,729,701 is exemplary of a typical prior art female electrical box-like receptacle for a typical tab.

U.S. Pat. No. 3,836,947 is exemplary of a typical prior art female electrical box-like receptacle for a male terminal with a dimple and a leaf spring.

U.S. Pat. No. 4,540,233 is exemplary of another typical prior art female electrical box-like receptacle block for a male terminal for improved contact.

U.S. Pat. No. 4,781,628 is exemplary of another typical prior art female electrical terminal having a resilient latch tang with structure to protect the latch tang, where the structure to protect the latch tang is part of an appendage which is juxtaposed the receptacle of the female terminal, providing versatility in configuring and sizing the receptacle itself.

It is respectfully requested that this citation of art be made of record with regard to the within application.

SUMMARY OF THE INVENTION

The present invention is a female blade receptacle for a male blade or terminal, particularly for a female blade receptor in a plug for a business machine or computer. The female blade receptacle of the present invention is a significant improvement over female blade receptacles of the prior art. The present invention is economical in using a minimum amount of metal, it saves labor cost by being adapted for automation and the flexibility of its shape enables effective full one side contact on a single side for a wide variety of male blade variants. The female blade receptacle may first be used in a premold or core before being molded into a plug.

According to the present invention, a stamped metal female blade receptacle for a molded plastic plug has a crimp end and a blade receiving portion. The crimp end has a pair of crimp arms. The blade receiving portion has a flat side, a curved side, and a back portion. The flat side and curved sides extend longitudinally and substantially on a perpendicular plane from the back portion. The sides are substantially the length of the blade receiving portion. The curve of the curved side is longitudinal and convex within the blade receiving portion. The sides each have longitudinal edges which are substantially parallel to each other and substantially the same height.

The curved side may be resilient, spring biased and have blade guides such as lips which may be flared.

A metal stamping strip of female blade receptacles for a molded plastic plug has each receptacle with a crimp end and a blade receiving portion. The crimp end is a pair of crimp arms. The blade receiving portion has a flat side, a curved side, and a back portion. The flat side and curved sides extend longitudinally and substantially on a perpendicular plane from the back portion. The sides are substantially the length of the blade receiving portion. The curve of the curved side is longitudinal and convex within the blade receiving portion. The sides each have longitudinal edges which are substantially parallel to each other and substantially the same height. The stamping strip has an end strip from which the receptacles integrally extend.

Alternate receptacles may have an integral folding strip and alternate receptacles on the folding strip may be folded over and extend from the stamping strip in parallel array.

A molded plastic male blade female receptacle plug has at least one stamped metal female blade receptacle with a crimp end and a blade receiving portion. The crimp end has a pair of crimp arms. The blade receiving portion has-a flat side, a curved side, and a back portion. The flat side and curved sides extend longitudinally and substantially on a perpendicular plane from the back portion. The sides are substantially the length of the blade receiving portion. The curve of the curved side is longitudinal and convex within the blade receiving portion. The sides each have longitudinal edges which are substantially parallel to each other and substantially the same height.

The plug may have more than one female blade receptacle or three female blade receptacles.

Although such novel feature or features believed to be characteristic of the invention are pointed out in the claims, the invention and the manner in which it may be carried out, may be further understood by reference to the description following and the accompanying drawing.

BRIEF DESCRIPTION OF THE DRAWINGS

FIG. 1 is a perspective view of the present invention.

FIG. 2 is a side elevation of the blade receptacle of the present invention on a stamping strip end, which is shown in phantom.

FIG. 3 is a top plan view of FIG. 2, showing two blade receptacles on a stamping strip end, which is shown in phantom.

FIG. 4 is a section of one blade receptacle of FIG. 3 at lines 4—4.

FIG. 5 is an end elevation of one blade receptacle of FIG. 3.

FIG. 6 is a female receptacle plug, partially cut away, including female blade receptacles of the present invention.

FIG. 7 is an end elevation of a prior art box-like female blade receptacle.

FIG. 8 is an end elevation of another prior art two armed spring-biased blade receptacle.

FIG. 9 is an end view perspective of another prior art overlapping box-like blade receptacle.

Referring now to the figures in greater detail, where like reference numbers denote like parts in the various figures.

DESCRIPTION OF THE PREFERRED EMBODIMENTS

The blade receptacle 10, as seen in FIGS. 1–3, has a crimp end 11 and a receptacle portion 12. The receptacle portion 12 comprises a flat side 13 and a curved side 14. The receptacle portion 12 has a flared lip guide 15 on the curved side 14 and a flared guide lip 16 on the flat side 13.

The crimp end 11 includes crimp arms 17 and 18.

The flat side 13 and curved side 14 define an opening 19 to receive a blade.

Both crimp arms 17 and 18 have end swedges 20. As can be seen in FIGS. 2 and 3, the blade receptacle 10 is on a stamping strip end 21, shown in phantom.

In FIG. 3, the blade receptacles 10 are stamped on the stamping strip 21, as shown in phantom, alternately folded over in parallel alignment, with the next blade receptacle 10, folded over and including a folding strip 22, shown in phantom.

FIG. 6 shows a typical female receptacle plug 30 with blade openings 31. At the cut away, a blade receptacle 10 can be seen engaged in the plug end 32.

In FIG. 7, a prior art box receptacle 40 is shown from one end. As can be seen, there is an inner extending dimple 41, extending into the opening 42.

As shown in FIG. 8, a spring-biased prior art double arm receptacle 50 is shown. The receptacle 50 has two arms 51, each having lips 52. The arms 51 extend from spring-biased arms 53, extending from a base 54.

As shown in FIG. 9, a prior art box receptacle 60 has opposing side portions 61 and 62, a wide side back portion 63 and a substantially parallel wide back portion 64.

The back portion 64 is off parallel and extends substantially to the side 61. Overfolded and biased against the back portion 64, is a short fold 65, engaging the wide back portion 64.

Operation

The present invention is particularly adapted to the automation of the making of female receptacle plugs 30. The blade receptacles 10 are progressively stamped on a stamping strip 23, so that alternate blade receptacles 10 are overfolded on the fold strip 22 and all blade receptacles 10 extend from the stamping strip end 21. By being thus constructed, the blade receptacles 10 can be put on reels (not shown) and fed into crimping machines where wire sets (not shown) may be simultaneously crimped to the blade receptacles 10 automatically.

A typical female receptacle plug 30, as shown in FIG. 6, is molded over blade receptacles 10, forming the female receptacle 30, with its plug end 32 having blade receptacles 10 adjacent the openings 31.

Once the blade receptacles 10 are crimped to the wires (not shown) of the electrical cable, the blade receptacles 10 can be engaged on load bars (not shown) and the female receptacle plug 30 molded over.

In use, a female receptacle plug 30 is engaged over male blades (not shown) on a business machine, or computer, to make an electrical connection.

Details of the Prior Art

In the past, box-like blade receptacles 40 as shown in Fig. 7 were restricted to a limited width and thickness of male blades. Electrical contact was maintained by the dimple 41 impinging on the blade, holding the blade against the opposite wall 43 of the folded metal box receptacle, the blade being in substantial full side contact.

A problem with the box receptacle 40 is that after multiple insertions, the dimple tends to wear and the electric contact may fail or deteriorate, so that there is no one sided full contact. Since different business machines and computers may have variations in male blades, the box receptacle 40 is further limited in its usability.

Double arm receptacle 50, as shown in FIG. 8, has the advantage of having an open side 55 and lips 52, to guide a male blade into the receptacle 50. The spring-biased arms 51 tend to be angulated as they come off the spring-biased arms 53 and generally when engaging a blade, provide only a partial line contact on both sides.

The box receptacle 60, as shown in FIG. 9, has the inherent limitation as to the width and thickness of male blades it can receive, by virtue of its box-like structure. Box receptacles, such as the box receptacle 60 generally do not have guide lips, or were they to be providable, they would entail greater complexity, more metal and a more complicated fabrication system. The wide back 64, while biased inward against a male blade (now shown) in use and reinforced by the short fold 65, still, nonetheless, tends to weaken its spring biasing in use and reuse, with the leverage of its length, weakening the biasing at its fulcrum at the edge where the wide back 64 meets the side 62 and is subject to fatigue. The box receptacle 60 also requires substantially more metal than the open fold of the blade receptacle 10 of the present invention.

The Present Invention

The present invention may be machine fed into crimping machines to crimp wires in sets for molding into a receptacle plug 30. The blade receptacle 10 may be loaded into premolds or cores (not shown) before crimping or molding.

In the molding of the female receptacle plug 30, the blade receptacles 10, loaded onto load bars (not shown), mold into the female receptacle plug 30. The load bars form the outer openings 31 and the cavity for the male blade (not shown) through the receptacle opening 19. Blade receptacles 10 engaged in cores or premolds are held in position on load bars both by the core or premold.

As can best be seen in FIG. 4, when the blade receptacle 10 is loaded on a mold bar, the curved side 14 is naturally spread open during the molding process. Thus, once molded, with the load bar removed, the curved side 14 tends to separate from the molding plastic and has room to flex, directly supported by the molding plastic. By the same token, a premold or core will support the receptacle side 14, after molding.

The gentle curvature of the curved side 14 forms a good line contact with one side of the male blade, self positioning the blade and providing one side full electrical contact with the flat side 13.

There is no risk of distorting the blade receptacle 10 by different size blades as might occur with a box contact.

The flared guide lips 15 and 16 add to the self positioning of the male blade.

There is only a small play from the center of the curve of the curved side 14 to the back portion 24, substantially lessening the likelihood of fatigue, weakening or breaking of the blade receptacle and the consequent loss of excellent one side full contact in continuous use. The molded plastic in the plug 30 limits the travel of the curved side 14 and supports it along its total surface, helping to limit fatigue and to help maintain the male blade in the opening 19 of the blade receptacle 10. The premold or core serves the same support function for the receptacle side 14 after molding.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A three sided stamped metal female blade receptacle for a molded plastic plug said receptacle including a longitudinal opening for engaging a variety of male blade variants within its length and providing full line side contact on one side and full surface contact on another side to an engaged blade, said receptacle comprising a crimp end and a blade receiving portion, said crimp end including a pair of crimp arms, said blade receiving portion including a flat side; a curved side; and a back portion, said flat side and curved side extending longitudinally and substantially on a perpendicular plane from said back portion and substantially the length of said blade receiving portion, said curve of said curved side longitudinal and convex within said blade receiving portion; and resilient and spring biased, said sides each having longitudinal edges, said longitudinal edges straight and substantially parallel to each other and substantially the same height.

2. The invention of claim 1 wherein said sides include blade guide means.

3. The invention of claim 2 wherein said blade guide means are lips.

4. The invention of claim 3 wherein said lips are flared.

5. A metal stamping strip of female blade receptacles for a molded plastic plug each receptacle including a longitudinal opening for engaging a variety of male blade variants within its length and providing full line side contact on one side and full surface contact on the other side to an engaged blade, each said receptacle comprising a crimp end and a blade receiving portion, said crimp end including a pair of crimp arms, said blade receiving portion including a flat side; a curved side; and a back portion, said flat side and curved side extending longitudinally and substantially on a perpendicular plane from said back portion and substantially the length of said blade receiving portion, said curve of said curved side longitudinal and convex within said blade receiving portion; and resilient and spring biased, said sides each having longitudinal edges, said longitudinal edges straight and substantially parallel to each other and substantially the same height, said stamping strip including an end strip, said receptacles integral to and extending from said end strip, alternate receptacles include an integral folding strip, and said alternate receptacles on said folding strip folded over said end strip and said receptacles extend from said stamping strip in parallel array.

6. In combination a molded plastic male blade receiving female receptacle plug, and said plug including at least one three sided stamped metal female blade receptacle, said female blade receptacle including a longitudinal opening for engaging a variety of male blade variants within its length and providing full line side contact on one side and full surface contact on the other side to an engaged blade, said female blade receptacle comprising a crimp end and a blade receiving portion, said crimp end including a pair of crimp arms, and said blade receiving portion including a flat side; a curved side; and a back portion, said flat side and curved side extending longitudinally and substantially on a perpendicular plane from said back portion and substantially the length of said blade receiving portion, said curve of said curved side longitudinal and convex within said blade receiving portion; and resilient and spring biased, said sides each having longitudinal edges, said longitudinal edges straight and substantially parallel to each other and substantially the same height.

7. The invention of claim 6 including more than one female blade receptacle.

8. The invention of claim 6 including three female blade receptacles.

* * * * *